United States Patent [19]

Kamide et al.

[11] Patent Number: 4,663,232

[45] Date of Patent: May 5, 1987

[54] ACRYLIC FIBER HAVING EXCELLENT DURABILITY AND DYEABILITY AND PROCESS FOR PREPARATION THEREOF

[75] Inventors: Kenji Kamide, Ikoma; Yutaka Honda, Suita; Shuji Kajita, Takatsuki, all of Japan

[73] Assignee: Asahi Kasei Kogyo Kabushiki Kaisha, Osaka, Japan

[21] Appl. No.: 728,276

[22] Filed: Apr. 29, 1985

[30] Foreign Application Priority Data

Nov. 13, 1984 [JP] Japan ..... 59-237455

[51] Int. Cl.[4] ..... D02G 3/00

[52] U.S. Cl. ..... 428/400; 264/177.1; 428/401

[58] Field of Search ..... 428/364, 400, 401; 264/182, 177 F

[56] References Cited

U.S. PATENT DOCUMENTS 4,448,740 5/1984 Sawanishi et al. ..... 264/182

FOREIGN PATENT DOCUMENTS 36-16461 9/1961 Japan .

OTHER PUBLICATIONS

M. Takahashi: "Seni Gakkai Shi", vol. 17, pp. 243-252 (1961).

*Primary Examiner*—Lorraine T. Kendell

*Attorney, Agent, or Firm*—Finnegan, Henderson, Farabow, Garrett & Dunner

[57] ABSTRACT

Disclosed is an acrylic fiber composed of an acrylonitrile homopolymer or copolymer whose surface consists of particulate and/or microfibrillar structures having a width of 0.01 to 0.5 μm and a length of 0.05 to 10 μm and fibrillar structures formed by aggregation of the particulate and/or microfibrillar structures and having a width of 0.1 to 10 μm and a length of at least 50 μm. The fiber is prepared by spinning a dope of an acrylonitrile homopolymer or copolymer in a solvent at a draft ratio of at least 5 into a coagulating bath comprising a solvent and a coagulant and having a composition such that a skin layer is not formed on the coagulated fiber; taking up the coagulated fiber from the coagulating bath so that the retention time in the coagulating bath is within 60 seconds; and then drawing the fiber in a drawing bath comprising a solvent and a coagulant and having a coagulating property to the dope and a composition such that a skin layer is not formed on the fiber.

3 Claims, 4 Drawing Figures

ACRYLIC FIBER HAVING EXCELLENT DURABILITY AND DYEABILITY AND PROCESS FOR PREPARATION THEREOF

BACKGROUND OF THE INVENTION (1) Field of the Invention

The present invention relates to an acrylic fiber having excellent durability and dyeability, which is composed of an acrylonitrile homopolymer or acrylonitrile copolymer, and a process for the preparation thereof.

(2) Description of the Related Art

Acrylic fibers are characterized in that they are prepared by a variety of preparation processes. The reason is that the starting polymer includes not only acrylonitrile homopolymers but also acrylonitrile copolymers comprising comonomers such as acrylamide, acrylic acid, sodium acrylate, styrene, sodium sulfonate, methyl acrylate, vinyl acetate, vinyl chloride and vinylidene chloride; that there are present many solvents, for example, inorganic solvents such as an aqueous solution of a rhodanate, an aqueous solution of zinc chloride and nitric acid and organic solvents such as dimethylformamide, dimethylacetamide and dimethylsulfoxide; and further that, in case of the wet spinning method, there are present a variety of aqueous and non-aqueous coagulants.

In the ordinary wet spinning method, for industrial reasons, for example, in view of spinnability and productivity, the composition of a coagulating bath is generally set so that a spinning dope is promptly coagulated in the coagulating bath. However, where a fiber is prepared by using such a coagulating bath, because of the strong coagulating force of the coagulating bath, a dense and hard skin layer having a thickness of about 0.1 μm to several μm is formed on the surface of the fiber and voids are formed in the interior. This skin layer inhibits dispersion of a dye at the dyeing step and it is considered that this skin layer will cause reduction of the physical properties of the fiber, such as softness. Furthermore, the presence of voids often results in defects of the physical properties, such as occurrence of a devitrification phenomenon, reduction of the dyeability, lack of softness and reduction of the durability. The skin layer and voids seemingly disappear if the fiber is subjected to post-treatment such as drawing and heat-treatment.

Acrylic fibers can be dyed with cationic dyes, and show an excellent durability and sharp dyeability. By dint of these characteristics, acrylic fibers are broadly used as curtains and carpets in the interior decorative field, as blankets in the field of bedding and as knitted articles and jersey cloths in the field of clothing.

With recent diversification of consumer's needs, development of acrylic fibers having a much improved durability and a deeper and better dyeability is eagerly desired.

SUMMARY OF THE INVENTION

Under the above-mentioned background, it is the primary object of the present invention to provide an acrylic fiber having excellent durability and dyeability.

In one aspect of the present invention, there is provided an acrylic fiber composed of an acrylonitrile homopolymer or acrylonitrile copolymer, the surface of the acrylic fiber consisting of particulate and/or microfibrillar structures having a width of 0.01 to 0.5 μm and a length of 0.05 to 10 μm and fibrillar structures formed by aggregation of the particulate and/or microfibrillar structures and having a width of 0.1 to 10 μm and a length of at least 50 μm.

In another aspect of the present invention, there is provided a process for preparing an acrylic fiber according to a wet method using a dope of an acrylonitrile homopolymer or acrylonitrile copolymer in a solvent, the process comprising spinning the dope at a draft ratio of at least 5 into a coagulating bath comprising a solvent and a coagulant and having a composition such that a skin layer is not formed on the coagulated fiber, taking up the coagulated fiber from the coagulating bath so that the retention time in the coagulating bath is within 60 seconds, and then drawing the fiber in a drawing bath comprising a solvent and a coagulant and having a coagulating property to the dope and a composition such that a skin layer is not formed on the fiber.

DESCRIPTION OF THE PREFERRED EMBODIMENTS

Figure 1A:
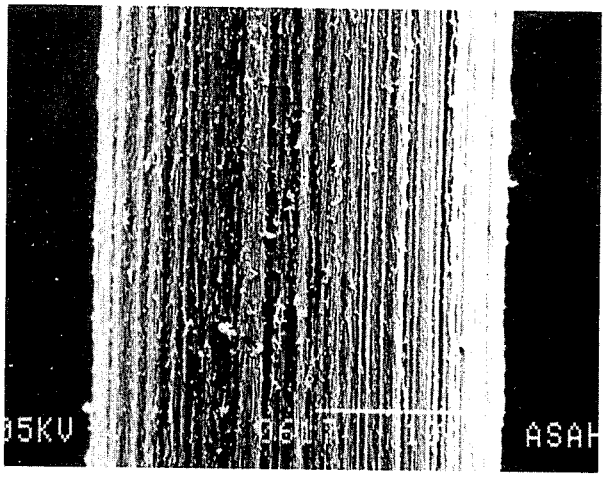
FIG. 1 show scanning electron micrographs illustrating the surface structure of the fiber of the present invention, and FIG. 2 show scanning electron micrographs illustrating the surface structure of a conventional fiber.

The fiber of the present invention is composed of an acrylonitrile homopolymer or acrylonitrile copolymer. The acrylonitrile copolymer comprises at least 50% by weight, preferably at least 85% by weight, of acrylonitrile and not more than 50% by weight, preferably not more than 15% by weight of at least one copolymerizable monoethylenically unsaturated monomer. The copolymerizable monoethylenically unsaturated monomer includes, for example, acrylic acid and its esters, methacrylic acid and its esters, acrylamide and N-substituted amides, vinyl halides such as vinyl chloride, vinyl esters such as vinyl acetate, vinyl dicarboxylic acids and esters thereof such as itaconic acid and maleic acid, vinylidene halides such as vinylidene chloride, vinylpyridine and N-substitution products thereof, vinylpyrrolidone, styrene, and sulfonic acid compounds and salts thereof such as allylsulfonic acid, methallylsulfonic acid and styrene-sulfonic acid. These monomers may be used either alone or in combination.

The fiber of the present invention is characterized in that the surface consists of particulate and/or microfibrillar structures having a width of 0.01 to 0.5 μm and a length of 0.05 to 10 μm. In a conventional acrylic fiber, these particulate and/or microfibrillar structures are not present on the surface. Only stripes which are relatively parallel to the fiber axis are observed. It is construed that the stripes seen in the conventional acrylic fiber are wrinkles formed by the volume shrinkage of the acrylic fiber at the drawing or heat-treating step or, in case of the dry spinning method, these stripes are formed by drawing traces of evaporation of a solvent. The particulate and/or microfibrillar structures are inherent structures possessed by the fiber of the present invention, which are formed by drawing gel particles, formed by the microphase separation at the coagulation step, in the direction of the fiber axis at the drawing step.

In case of a conventional acrylic fiber, since the coagulation is carried out in a coagulating bath having a skin layer-forming concentration which is lower than a level incapable of forming a skin layer, a dense and hard skin layer is formed on the surface of the fiber at the coagulating step. This skin layer inhibits diffusion of a dye at the dyeing step and hardens the touch of the fiber, resulting in reduction of the physical properties.

In the fiber of the present invention, this skin layer is not present, but particulate and/or microfibrillar structures are present instead. Because of the presence of these particulate and/or microfibrillar structures, a very excellent dyeability is attained, the dye adsorption rate is high, and a fiber having a soft touch can be obtained. This is one of the important characteristic features of the present invention. To our great surprise, it has been found that although a conventional fiber contains voids having a size of about 100 to about 2000 Å, which are formed at the coagulating and drawing steps, if the spinning process described hereinafter is adopted, a substantially transparent fiber where such voids are not substantially present can be obtained by coagulation and drawing. When this fiber is dyed, a deep and good color is manifested in the fiber. In a preferred fiber according to the present invention, the surface is formed of particulate and/or microfibrillar structures having a width of 0.05 to 0.3 μm and a length of 0.5 to 10 μm and the long axes of these structures extend in the direction of the fiber axis.

Figure 1B:
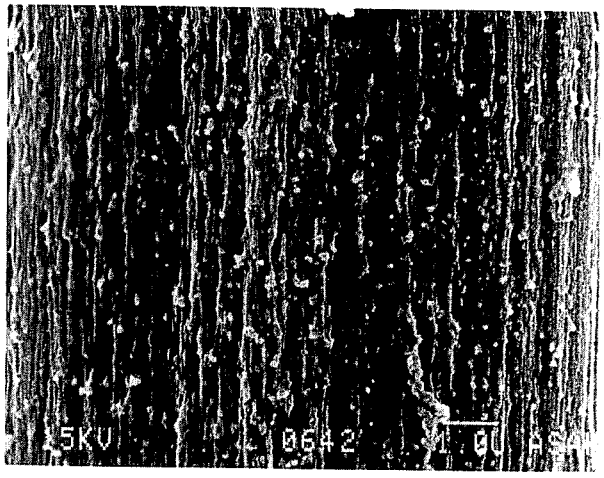
Figure 2A:
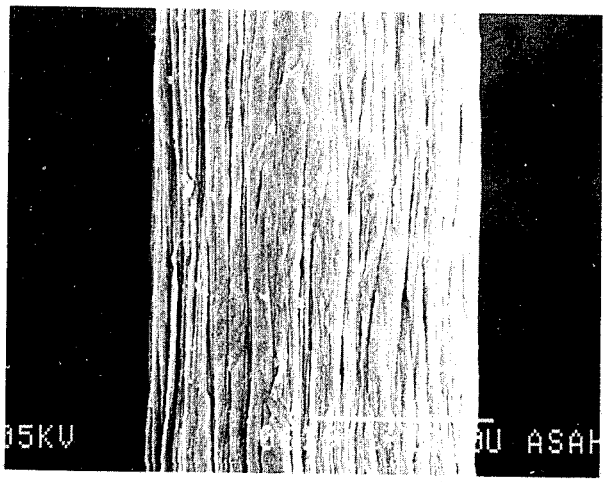
Figure 2B:
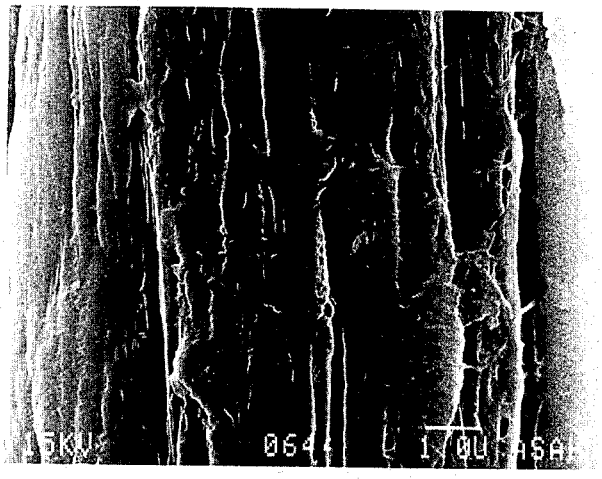

The presence of the particulate and/or microfibrillar structures can be confirmed visually with a commercially available scanning electron microscope, for example, a scanning electron microscope JSM-35CF supplied by JEOL LTD., at an accelerating voltage of 5 to 15 kV at 3000 to 30,000 magnification. Scanning electron micrographs of a typical instance of the fiber of the present invention are shown in FIG. 1. Scanning electron micrographs of a typical instance of the conventional fiber are shown in FIG. 2.

Another structural feature of the fiber of the present invention is that the surface is formed of fibrillar structures formed by aggregation of the abovementioned particulate and/or microfibrillar structures and having a width of 0.1 to 10 μm and a length of at least 50 μm. The long axes of the fibrillar structures extend substantially in parallel to the direction of the fiber axis. In a preferred fiber, fibrillar structures having a width of 0.1 to 10 μm continuously extend in the direction of the fiber axis over a length of at least 100 μm and occupy 20 to 100% of the surface area of the fiber. In a conventional acrylic fiber, the presence of such fibrillar structures is not confirmed, but stripes resembling the fibrillar structures of the present invention, which are considered to be wrinkles formed by the volume shrinkages or traces of evaporation of a solvent, as described above, are present. However, the length of continuity of these stripes are generally less than 50 μm and about 1 to about 30 μm in many cases. By dint of the presence of these fibrillar structures, the acrylic fiber of the present invention is tough and shows a very excellent durability. Furthermore, the fiber has improved abrasion resistance, fibrillation resistance and compression elastic recovery. In addition, occurrence of fly wastes is reduced in the fiber of the present invention. The presence of the fibrillar structures can be confirmed by observation using a scanning electron microscope as described above. The proportion of the fibrillar structure to the surface area of the fiber can also be confirmed similarly by observation using a scanning electron microscope.

The fiber of the present invention can be obtained according to the following wet spinning method using a dope of an acrylonitrile hompolymer or acrylonitrile copolymer in a solvent therefor. The dope is spun at a draft ratio of at least 5 into a coagulating bath comprising a solvent and a coagulant and having a composition such that a skin layer is not formed on the coagulated fiber, the coagulated fiber is taken out from the coagulating bath so that the retention time in the coagulating bath is within 60 seconds, and then the fiber is drawn in a coagulating bath comprising a solvent and a coagulant and having a coagulating property to the dope and a composition such that a skin layer is not formed on the fiber.

The composition of the concentration incapable of forming a skin layer can be determined by using a scanning electron microscope. More specifically, the dope used for formation of a fiber is coated in a thickness of several μm to about 1 mm on a slide glass and is immersed in a coagulating bath prepared from a solvent and a coagulant. The temperature of the coagulating bath is set at a level used for formation of the fiber. A necessary number of coagulating baths differing in the concentration of the coagulant by 1% by weight respectively are prepared. After completion of the coagulation, the coagulation product is washed with water and with methanol and then air-dried to obtain a filmy product. The surface of the film is observed by using a scanning electron microscope, for example, a scanning electron microscope JSM-35CF supplied by JEOL LTD., at an accelerating voltage of 5 to 15 kV at 10000 magnification. At the time of observation, Au is coated on the surface in a thickness of 50 to 500 Å. Where a skin layer is formed on the surface of the film, by this observation at 10,000 magnification, the surface is substantially flat and only the presence of some undulations and adhering substances on the surface is confirmed. If the concentration of the coagulant is within the range incapable of forming a skin layer, pores having a size of 0.05 μm to scores of μm or particles having a size of about 0.05 to about 0.5 μm are observed on the surface. According to this method, the lower limit of the permissible concentration rate incapable of forming a skin layer can be determined. The upper limit of the coagulant concentration may be determined as the coagulation-impossible concentration of the dope. Furthermore, the composition of the drawing bath having a coagulation property to the dope is defined as a composition having such a coagulating property that if the dope is immersed in the drawing bath directly without passage through the coagulating bath, the dope is solidified within 30 minutes.

The coagulating bath used in the wet spinning method of the present invention comprises a solvent capable of dissolving therein an acrylonitrile homopolymer or acrylonitrile copolymer and a coagulant. The solvents used include inorganic solvents, for example, concentrated aqueous solutions of inorganic salts such as a rhodanate, lithium bromide, zinc chloride and aluminum perchlorate and concentrated aqueous solutions of inorganic acids such as nitric acid, sulfuric acid and perchloric acid, and organic solvents, for example, amide compounds such as dimethylformamide and dimethylacetamide, nitrile compounds, sulfone and sulfoxide compounds such as dimethylsulfoxide, thiocyanate compounds, nitro compounds, amino compounds, phosphorus compounds, carbonate compounds and mixtures thereof.

The coagulant used include, for example, water, methanol, ethanol, acetone, acetic acid, ethylene glycol, carbon tetrachloride, xylene and benzene. A coagulating bath industrially used comprises water and a solvent as described above. In view of productivity, for example, the ease of the recovery operation, the same solvent as used for formation of the dope is ordinarily used as the solvent for the coagulating bath.

Conventionally, the concentration of a solvent in a coagulating bath is within the range capable of forming a skin layer. The reason is that when the industrial productivity is taken into consideration, conditions suitable for the spinning stability and the operation adaptability can be easily selected. Moreover, at a concentration incapable of forming a skin layer, a fiber coagulated in the coagulating bath meanders, the obtained fiber is opaque with the loss of the transparency, and a long time is required for completion of the coagulation.

In the present invention, in order to obviate these disadvantages, the dope is coagulated at a draft ratio of at least 5 in a coagulating bath having a coagulant concentration adjusted to a level incapable of forming a skin layer, the coagulated fiber is taken out from the coagulating bath so that the retention time in the coagulating bath is within 60 seconds, and the fiber is drawn in a drawing bath having a coagulating property to the dope and a coagulant concentration adjusted to a level incapable of forming a skin layer.

The spinning draft ratio referred to in the present invention is expressed in terms of the ratio of the speed ($V_2$) of the take-out roller to the linear speed ($V_1$) of the extrusion of the spinning dope from the nozzle hole.

In the process of the present invention, the coagulated fiber is taken out so that the spinning draft ratio is at least 5, preferably from 5 to 100. If the draft ratio is lower than 5, sagging or breaking of the fiber takes place in the coagulating bath and the fiber is undesirably wound in a rotary portion, resulting in reduction of the operation adaptability, and the obtained fiber is opaque white and not transparent.

In the present invention, the retention time of the spun fiber in the coagulating bath is one of the important factors. If the retention time is too short, the coagulation is incomplete and breaking or adhesion of the fiber is caused. If the retention time is too long, the fiber composed of a coaguated gel exhibits little or no flowability and the orientation of fibrils or microfibrils becomes insufficient, with the result that an excellent durability cannot be obtained. A preferred retention time in the coagulating bath depends on the coagulant concentration of the coagulating bath, the polymer concentration of the dope and the fineness of the obtained fiber, but the retention time is within 60 seconds and preferably 0.5 to 30 seconds.

The concentration range incapable of forming a skin layer varies depending upon the particular solvent for the acrylonitrile homopolymer or acrylonitrile copolymer which is used for the coagulating bath. Where the coagulant is water, a preferred concentration of the solvent is 38% to 50% by weight for nitric acid, 65% to 90% by weight for dimethylformamide, dimethylacetamide or dimethylsulfoxide or 20% to 40% by weight for a rhodanate or zinc chloride. Furthermore, the optimum concentration varies more or less according to the temperature or by addition of a third component. Accordingly, precise determination should be performed by using a scanning electron microscope in the above-mentioned manner.

The fiber taken out from the coagulating bath is, without passage through the water washing step, drawn in a drawing bath having a coagulating property to the dope and having a coagulant concentration adjusted to a level incapable of forming a skin layer. The draw ratio is ordinarily set within a range of 2 to 20, preferably at least 5. The drawing may be carried out at room temperature, but the temperature is sometimes elevated so as to increase the drawability. Multistage drawing may be optionally carried out. By this drawing, according to the present invention, a void-free fiber is obtained in which microfibrils and fibrils are oriented in a good state. If the drawing is not appropriately carried out, voids are formed in the fiber and the orientation of microfibrils and fibrils becomes incomplete, and the resulting fiber has poor physical properties.

Ordinarily, the fiber prepared according to the process of the present invention is subjected to a customary water washing treatment so that the residual solvent content is lower than 0.1% by weight based on the fiber. In order to improve the physical properties, for example, the strength, the fiber may be re-drawn in hot water or steam. Moreover, in order to remove water, the fiber is dried under no tension or under application of tension. Then, the heat treatment is carried out to increase the stability. The heat treatment is performed in pressurized steam, hot air or hot water or on a hot plate.

The characteristic properties, such as durability and dyeability, of the fiber of the present invention are not degraded by the water washing, re-drawing, and heat-treatment.

The fiber of the present invention has excellent durability and dyeability. The fiber has broad application fields as interior decorative articles such as carpets and curtains, bedding articles such as blankets and clothing articles such as knitted articles and jersey cloths. For example, a carpet obtained from the fiber of the present invention has excellent durability and a compression elastic recovery 1.5 to 2 times as high as that of a conventional product. Accordingly, formation of dust (fly wastes) at the spinning step can be minimized, the amount of dust is about 1/10 of the amount of dust formed in case of the conventional fiber. Moreover, the operation adaptability is improved.

The fiber of the present invention can be evaluated based on the product of the strength and elongation at break (LS g/d×LE %) by measuring the loop strength and loop elongation at break according to the tensile test method of Japanese Industrial Standard (JIS) L-1069. The strength-elongation product of the fiber of the present invention is 1.5 to 3 times that of the conventional fiber.

The fibrillation resistance of the fiber of the present invention can be confirmed according to the following method.

The fibers are packed in a polyvinyl chloride tube having an inner diameter of 8 mm in as large as possible. The packed fibers are cut so that the fibers are exposed from the top end of the tube by a length of 5 mm. The exposed ends of the fibers are set at a center of a rotary disc of a stainless steel net of 40 mesh. A load of 200 g is applied and the disc is rotated at 60 rpm frictionally with the fiber end. If fibrillation is caused in the fiber, the top ends of the fibers become opaque. When the top ends are observed by an optical microscope, it is seen that the top ends of the fibers are fibrillated. The fibrillation resistance is evaluated based on the number of rotations required for occurrence of this fibrillation. If the rotation number is 5,000 or more, the fibrillation resistance is good. If the rotation number is 7,000 or more, the fibrillation resistance is very good. In case of a fiber having an especially high fibrillation resistance, almost no fibrillation is caused and the top ends of the filaments are worn and rounded at the above test.

The present invention will now be described in detail with reference to the following examples, in which percentages are by weight unless otherwise specified.

EXAMPLE 1

A copolymer comprising 91.5% of acrylonitrile, 8% of methyl acrylate and 0.5% of sodium methallylsulfonate was dissolved in an aqueous 67% solution of nitric acid at 0° C. to obtain a spinning dope having a polymer concentration of 16%.

The spinning dope was extruded into a coagulating bath through a spinneret having 100 orifices, each having a diameter of 0.7 mm. The coagulated fiber was taken out at a draft ratio of 20. The coagulating bath consisted of an aqueous 42% solution of nitric acid. The temperature therecf was 5° C. The retention time of the fiber in the coagulating bath was 11 seconds. Subsequently, the fiber was drawn at a draw ratio of 10 in a drawing bath having a nitric acid concentration of 42% at a bath temperature of 70° C. The drawn fiber was washed with water, sufficiently dried in hot air at 130° C. and then subjected to a relax heat treatment in steam at 120° C.

When the obtained fiber was observed by a scanning electron microscope, it was found that microfibrillar structures having a width of 0.1 to 0.2 μm and a length of 0.5 to 3 μm extended in the axial direction of the fiber on the surface of the fiber, and it also was found that these microfibrillar structures were aggregated to form fibrillar structures having a width of 0.5 to 5 μm and a length of at least 100 μm, 350 μm or more in an extreme case extending in the direction of the fiber axis. The fibrillar structures occupied the entire surface of the fiber. The scanning electron micrographs are shown in FIG. 1 in which (a) shows the fibrillar structures observed at an acceleration voltage of 5 kV at 3,000 magnification, the scale being 10 μm, and (b) shows the microfibrillar structures observed at an acceleration voltage of 15 kV at 10,000 magnification, the scale being 1 μm.

The water-washed fiber was washed with methanol, air-dried and embeded in a methacrylate resin. The fiber embedded resin was cut vertically to the fiber axis into an ultra-thin slice having a thickness of about 0.1 μm. Carbon was vacuum-deposited on the slice in a vacuum deposition apparatus and the embedding resin was dissolved out by chloroform. Then the slice was observed by a transmission electron microscope at an acceleration voltage of 100 kV at 50,000 magnification. Voids having a size larger than 200 Å were not present at all. When the fibrillation test of the fiber was performed, it was found that the fibrillation-causing rotation number was 10,000.

A carpet having a cut pile length of 10 mm was prepared by using this fiber. The compression elastic recovery was determined by applying a load of 0.2 kg/cm$^2$ 10000 times and measuring the height reduction ratio. It was found that the height reduction ratio of the fiber of the present invention was 14% based on the original height, which is much smaller than 28% of the conventional fiber.

The fiber of the present invention was dyed with a cationic dye at a bath ratio of 1:50 at 100° C. for 60 minutes. The fiber showed a very good deep dyeability which was evaluated as class 5 by observation by naked eye, while the dyeability of the conventional fiber was class 3 (route standard yarn was used as a class 3 reference sample).

EXAMPLE 2

A copolymer comprising 91.5% of acrylonitrile, 8% of methyl acrylate and 0.5% sodium methallylsulfonate was dissolved in a commercially available 100% by volume solution of dimethylacetamide at 25° C. to form a spinning dope having a polymer concentration of 20%.

The spinning dope was extruded into a coagulating bath through a spinneret having 100 orifices, each having a diameter of 0.7 mm. The coagulated fiber was taken out from the coagulating bath at a draft ratio of 15. The coagulating bath consisted of an aqueous 75% solution of dimethylacetamide. The temperature was 25° C. The retention time of the fiber in the coagulating bath was 11 seconds. Then, the fiber was drawn at a draw ratio of 10 in a drawing bath consisting of an aqueous 75% solution of dimethylacetamide at a bath temperature of 60° C. The drawn fiber was washed with water, sufficiently dried in hot air at 130° C. and subjected to a relax heat treatment in steam at 120° C.

When the obtained fiber was examined by a scanning electron microscope, it was found that on the surface of the fiber, microfibrillar structures having a width of 0.1 to 0.2 μm and a length of 0.5 to 3 μm extended in the direction of the fiber axis. It also was found that these microfibrillar structures were aggregated to form fibrillar structures having a width of 0.5 to 5 μm and a length of at least 100 μm, 300 μm in an extreme case, in the direction of the fiber axis. The fibrillar structures occupied 45% of the surface area of the fiber.

When the water-washed fiber was observed by a transmission electron microscope in the same manner as described in Example 1, it was found that voids having a size larger than 200 Å were not present at all. The product of the loop strength and loop elongation at break of the fiber was 261 and the fibrillation resistance was 8,500 rotations.

EXAMPLE 3

A copolymer comprising 91.5% of acrylonitrile, 8% of methyl acrylate and 0.5% of sodium methallylsulfonate was dissolved in a commercially available 100% by volume solution of dimethylformamide at 25° C. to form a spinning dope having a polymer concentration of 16% by weight.

The spinning dope was extruded into a coagulating bath through a spinneret having 100 orifices, each having a diameter of 0.7 mm. The coagulated fiber was taken out from the coagulating bath at a draft ratio of 25. The coagulating bath consisted of an aqueous 75% solution of dimethylformanide. The bath temperature was 25° C. The retention time of the fiber in the coagulating bath was 9 seconds. Subsequently, the fiber was drawn at a draw ratio of 10 in a drawing bath consisting of an aqueous 77% solution of dimethylformamide at a bath temperature of 60° C. The drawn fiber was washed with water, sufficiently dried in hot air at 130° C. and then subjected to a relax heat treatment in steam at 120° C.

When the obtained fiber was observed by a scanning electron microscope, it was found that on the surface of the fiber, microfibrillar structures having a width of 0 1 to 0.2 μm and a length of 0.5 to 3 μm, which extended in the direction of the fiber axis, and particulate structures having a diameter of 0.1 to 0.2 μm were present. It also was found that these microfibrillar structures were aggregated to form fibrillar structures having a width of 0.5 to 5 μm and a length of 70 to 150 μm in the direction of the fiber axis. The fibrillar structures occupied 95% of the surface area of the fiber. The product of the loop strength and loop elongation of the fiber was 234 and the fibrillation resistance was 8000 rotations. When a carpet was formed by using this fiber, the weight reduction ratio was 16%.

EXAMPLE 4

A copolymer comprising 91.5% of acrylonitrile, 8% of methyl acrylate and 0.5% of sodium methallylsulfonate was dissolved in a commercially available 100% by volume solution of dimethylsulfoxide at 25° C. to form a spinning dope having a polymer concentration of 16%.

The spinning dope was extruded in a coagulating bath through a spinneret having 100 orifices, each having a diameter of 0.7 mm. The coagulated fiber, was taken out at a draft ratio of 20. The coagulating bath consisted of an aqueous 75% solution of dimethylsulfoxide. The bath temperature was 25° C. The retention time of the fiber in the coagulating bath was 14 seconds. Subsequently, the fiber was drawn at a draw ratio of 10 in a drawing bath consisting of an aqueous 75% solution of dimethylsulfoxide at a bath temperature of 65° C. The drawn fiber was washed with water, sufficiently dried in hot air at 130° C. and then subjected to a relax heat treatment in steam at 120° C.

When the obtained fiber was observed by a scanning electron microscope, it was found that on the surface of the fiber, there were present microfibrillar structures having a width of 0.1 to 0.2 μm and a length of 0.5 to 3 μm, which extended in the direction of the fiber axis, and particulate structures having a diameter of 0.1 to 0.2 μm. It also was found that these microfibrillar structures were aggregated to form fibrillar structures having a width of 0.5 to 5 μm and a length of at least 50 μm and extending in the direction of the fiber axis. The fibrillar structures occupied 90% of the surface area of the fiber. The product of the loop strength and loop elongation at break was 226.

EXAMPLE 5

A copolymer comprising 91.5% of acrylonitrile, 8% of methyl acrylate and 0.5% of sodium methallylsulfonate was dissolved in an aqueous 50% solution of sodium thiocyanate at 0° C. to form a spinning dope having a polymer concentration of 12%.

Then, the spinning dope was extruded into a coagulation bath through a spinneret having 100 orifices, each having a diameter of 0.7 mm. The coagulated fiber was taken out at a draft ratio of 15. The coagulating bath consisted of an aqueous 35% solution of sodium thiocyanate. The bath temperature was 3° C. The retention time of the fiber in the coagulating bath was 22 seconds. Subsequently, the fiber was drawn at a draw ratio of 10 in a drawing bath consisting of an aqueous 35% solution of sodium thiocyanate at a bath temperature of 60° C. The drawn fiber was washed with water, sufficiently dried in hot air at 130° C. and then subjected to a relax heat treatment in steam at 120° C.

When the obtained fiber was observed by a scanning electron microscope, it was found that microfibrillar structures having a width of 0.1 to 0.2 μm and a length of 0.5 to 3 μm, which extended in the direction of the fiber axis, were formed on the surface of the fiber. It also was found that these microfibrillar structures were aggregated to form fibrillar structures having a width of 0.5 to 5 μm and a length of at least 60 μm and extending in the direction of the fiber axis. The product of the loop strength and loop elongation at break of the fiber was 234.

COMPARATIVE EXAMPLE 1

A copolymer comprising 91.5% of acrylonitrile, 8% of methyl acrylate and 0.5% of sodium methallylsulfonate was dissolved in an aqueous 67% solution of nitric acid at 0° C. to form a spinning dope having a polymer concentration of 16%.

The spinning dope was extruded into a coagulating bath through a spinneret having 100 orifices, each having a diameter of 0.7 mm. The coagulated fiber was taken out at a draft ratio of 0.5. The coagulating bath consisted of an queous 35% solution of nitric acid. The bath temperature was 2° C. The retention time of the fiber in the coagulating bath was 80 seconds. Subsequently, the fiber was drawn at a draw ratio of 10 in a drawing bath consisting of an aqueous 35% solution of nitric acid at a bath temperature of 60° C. The drawn fiber was washed with water, sufficiently dried in hot air at 130° C. and then subjected to a relax heat treatment in steam at 120° C.

The product of the loop strength and loop elongation at break of the fiber was 123. The fibrillation resistance was 3000 rotations. When the water-washed fiber was observed by a transmission electron microscope in the same manner as described in Example 1, it was found that voids having a size of 200 to 2000 Å were present throughout the section of the fiber and a void-free skin layer having a thickness of about 0.5 μm was formed on the surface.

When the obtained fiber was observed by a scanning electron microscope, it was found that microfibrillar or particulate structures were not present at all on the surface but stripes having a length of 5 to 10 μm and extending substantially in parallel to the direction of the fiber axis were formed on the surface. The scanning electron microscope photographs are shown in FIG. 2, in which (a) shows the surface structure observed at an acceleration voltage of 5 kV at 3000 magnification and (b) shows the surface structure observed at an acceleration voltage of 15 kV at 10,000 magnification.

When the fiber was dyed with a cationic dye, the dyeability was poor and class 2 as evaluated by observation by the naked eye.

When a cut pile carpet was prepared by using this fiber and the height reduction ratio was determined in the same manner as described in Example 1, it was found that the height reduction ratio was as high as 35%.

We claim:

1. An acrylic fiber composed of an acrylonitrile homopolymer or acrylonitrile copolymer, the surface of said acrylic fiber consisting of microfibrillar structures having a width of 0.01 to 0.5 μm and a length of 0.05 to 10 μm and fibrillar structures formed by aggregation of said microfibrillar structures and having a width of 0.1 to 10 μm and a length of at least 50 μm.

2. An acrylic fiber according to claim 1 wherein said microfibrillar structures have a width of 0.05 to 0.3 μm and a length of 0.5 to 10 μm, whose long axes extend in the direction of the fiber axis.

3. An acrylic fiber according to claim 1 or 2 wherein said fibrillar structures extend substantially in parallel to the direction of the fiber axis over a length of at least 100 μm.

* * * * *